US007111352B2

(12) United States Patent
Yu

(10) Patent No.: US 7,111,352 B2
(45) Date of Patent: Sep. 26, 2006

(54) CLEANING BRUSH STRUCTURE WITH REPLACEABLE BRUSH HAIR PLATE

(76) Inventor: Shu-Feng Yu, 11F., No. 14, Lane 71, Ande St., Sindian City, Taipei County (TW)

( * ) Notice: Subject to any disclaimer, the term of this patent is extended or adjusted under 35 U.S.C. 154(b) by 0 days.

(21) Appl. No.: 10/963,501

(22) Filed: Oct. 14, 2004

(65) Prior Publication Data

US 2006/0080797 A1 Apr. 20, 2006

(51) Int. Cl.
*A46B 7/04* (2006.01)

(52) U.S. Cl. ..... 15/176.5; 15/176.4

(58) Field of Classification Search ..... 15/176.1, 15/176.4, 176.5
See application file for complete search history.

(56) References Cited

U.S. PATENT DOCUMENTS 1,750,500 A * 3/1930 Weisz ..... 15/176.4
1,908,510 A * 5/1933 Dodson ..... 15/176.4
2,225,331 A * 12/1940 Campbell ..... 15/188
2,306,051 A * 12/1942 Ghelber ..... 15/176.5
3,167,799 A * 2/1965 McKinley ..... 15/176.4
6,745,428 B1 * 6/2004 MacLean ..... 15/111

* cited by examiner

*Primary Examiner*—Randall Chin
(74) *Attorney, Agent, or Firm*—Bacon & Thomas PLLC

(57) ABSTRACT

The present invention discloses a cleaning brush structure having a replaceable brush hair plate, which comprises an accommodating groove being tapered in width from its front end to its rear end on a plate body of the cleaning brush and a baseboard being tapered in width from its front end to its rear end, such that the baseboard can be secured into the accommodating groove and will not fall out easily. Further, the accommodating groove has an opening disposed above the accommodating groove and slightly smaller than the bottom thereof, and its rear end is broader than its front end, such that when a user takes out the baseboard for replacement or cleaning, the baseboard will not come out uncontrollably due to the excessively applied force.

4 Claims, 4 Drawing Sheets

CLEANING BRUSH STRUCTURE WITH REPLACEABLE BRUSH HAIR PLATE

FIELD OF THE INVENTION

The present invention generally relates to cleaning brushes, more particularly to a cleaning brush structure having a replaceable brush hair plate.

BACKGROUND OF THE INVENTION

In the area of general cleaning accessories, a brush used for cleaning is very common to everyone, and one of these cleaning brushes will be described briefly below.

Please refer to FIG. 1. A cleaning brush 10 comprises a slender rod body 11, a plate member 12 extended from one end of the slender rod body 11, a brush hair plate 14 integrally coupled onto the plate member 12 to form a brush hair plate.

Further, the plate member 12 comprises a metal plate 15 protruded from the front of the plate member 12 for removing a tough dirt or stain. The brush hair plate 14 comprises a plurality of brush hairs or scrubbing cloths; and the embodiment as shown in FIG. 1 adopts a plurality of brush hairs. Further, the slender rod body 11 has a handle 16 at the other end to facilitate a user to hold the handle for cleaning.

In the manufacturing process of the aforementioned cleaning brush 10, it is nothing more than simply making a cleaning brush for a particular application, such as manufacturing the cleaning brush 14 with a plurality of brush hairs or scrubbing cloths and then integrally coupling the plate member 12 of the cleaning brush 10 to form a finished goods of the cleaning brush for a single use. However, the mass production process for producing various different brush hair plates 14 according to the prior arts generally combines the brush hair plate 14 with a slender rod body 11 and a handle 16 together to fulfill the requirements for different applications of the brush hair plate 14, but such manufacturing method has the following shortcomings.

1. Since the brush hair plate 14 is integrally coupled with the plate member 12 of the cleaning brush 10, therefore the brush hair cannot be replaced after the brush hair plate 14 has been used for a long time or gets too dirty that causes problems to the cleaning, or the brush hair plate 14 is damaged. Users have to buy a brand new cleaning brush for the replacement and thus increasing the costs.

2. As to the manufacture of the cleaning brushes for various different applications, a particular type of the slender rod body 11 with a particular type of the brush hair plate 14 must be made for each model. Such method not only wastes time, labor and materials, but also wastes earth resources, and thus such method is a very inefficient one.

3. If a user needs to use a different cleaning brush for a different cleaning job, it generally requires the user to buy another kind of cleaning brushes to meet the need. However, buying all kinds of required brushes not only wastes money, but also takes up spaces for storing these brushes. It will cause problems for small family to find a place for storing a number of cleaning brushes. Therefore, the traditional cleaning brushes have not taken the space for storage into consideration and are definitely inefficient.

In view of the description above, the plate member 12 of a prior-art cleaning brush 10 is integrally coupled with the brush hair plate 14, which is an issue causing inconvenience to the application by user and requiring improvements on its design to overcome the existing shortcomings.

SUMMARY OF THE INVENTION

In view of the description above, the design of integrally coupling the plate body of the cleaning brush with the brush hair plate causes the brush hair plate unable to be removed, replaced, or cleaned after a long-time use. Since the brush hair plate cannot be replaced, therefore users have to buy a new set of cleaning brush, which not only wastes earth resources, but also has a drawback of occupying too much storage space. Therefore, based on the actual requirements of the market and users, the inventor of the present invention conducted extensive researches and experiments, and finally invented a cleaning brush structure with a replaceable brush hair plate.

The primary objective of the present invention is to provide a structure for improving the prior-art design of integrally coupling the plate body and the brush hair plate that causes the brush hair plate unable to be replaced or cleaned and creates the problems of wasting resources and creating inconvenience and troubles to users. With the design of accommodating groove being tapered in width from its front end to its rear end on the plate body of the cleaning brush, the baseboard being tapered in width from its front end to its rear end, and the opening above the accommodating groove being slightly smaller than its bottom according to the present invention, the baseboard can have an advantage of being secured into the accommodating groove, and thus the baseboard will not fall off easily. In the meantime, the accommodating groove has an opening being disposed above the accommodating groove and slightly smaller than the bottom of the accommodating groove and its rear end is broader than its front end, such that when a user takes out the baseboard for replacement or cleaning, the baseboard will not come out uncontrollably due to the excessively applied force. In the meantime, the present invention concurrently has the economic effect and complies with the environmental protection requirements.

Another objective of the present invention is to build a first latch groove disposed in the wall at the rear end of the accommodating groove and having an indented opening, a second latch groove disposed in the wall at the front end of the accommodating groove, a triangular resilient latch disposed on the wall at the rear end of the baseboard, and a triangular protruded latch disposed on the wall at the front end of the baseboard, such that the baseboard is embedded into the accommodating groove at an inclined angle, and the protruded latch can be embedded into the second latch groove and the resilient latch can be embedded into the first latch groove, and the brush hair plate is exposed and fixed outside the accommodating groove to define a cleaning brush head. If it is necessary to remove the baseboard, the resilient latch is pressed by the indented opening and then the rear end of the baseboard is lifted up to an inclined angle for a user to take out the baseboard.

The above and other objects, features and advantages of the present invention will become apparent from the following detailed description taken with the accompanying drawing.

DETAILED DESCRIPTION OF THE PREFERRED EMBODIMENTS

Figure 1:
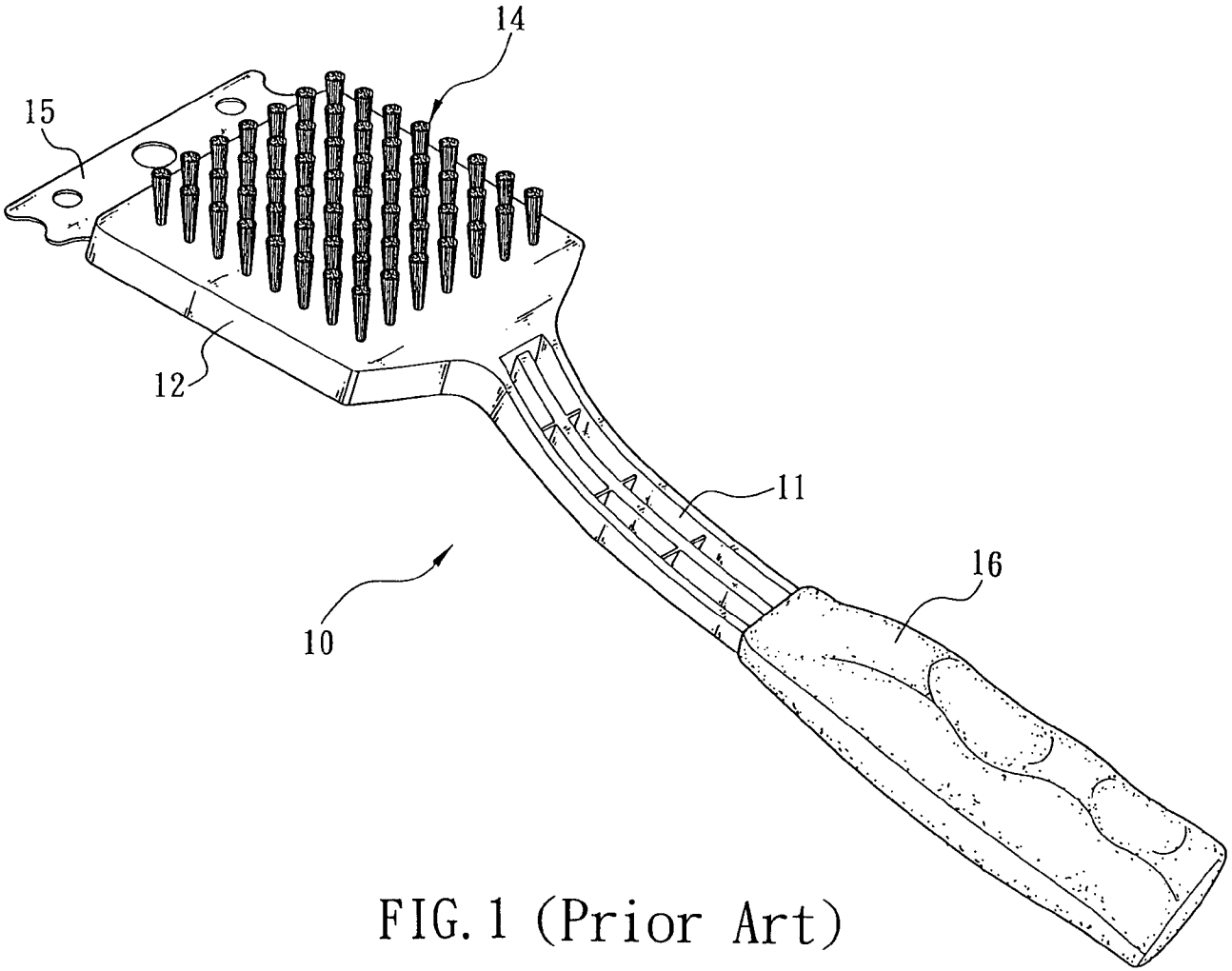
FIG. 1 (Prior Art)
FIG. 1 is a perspective view of a prior-art cleaning brush and its parts.
Figure 2:
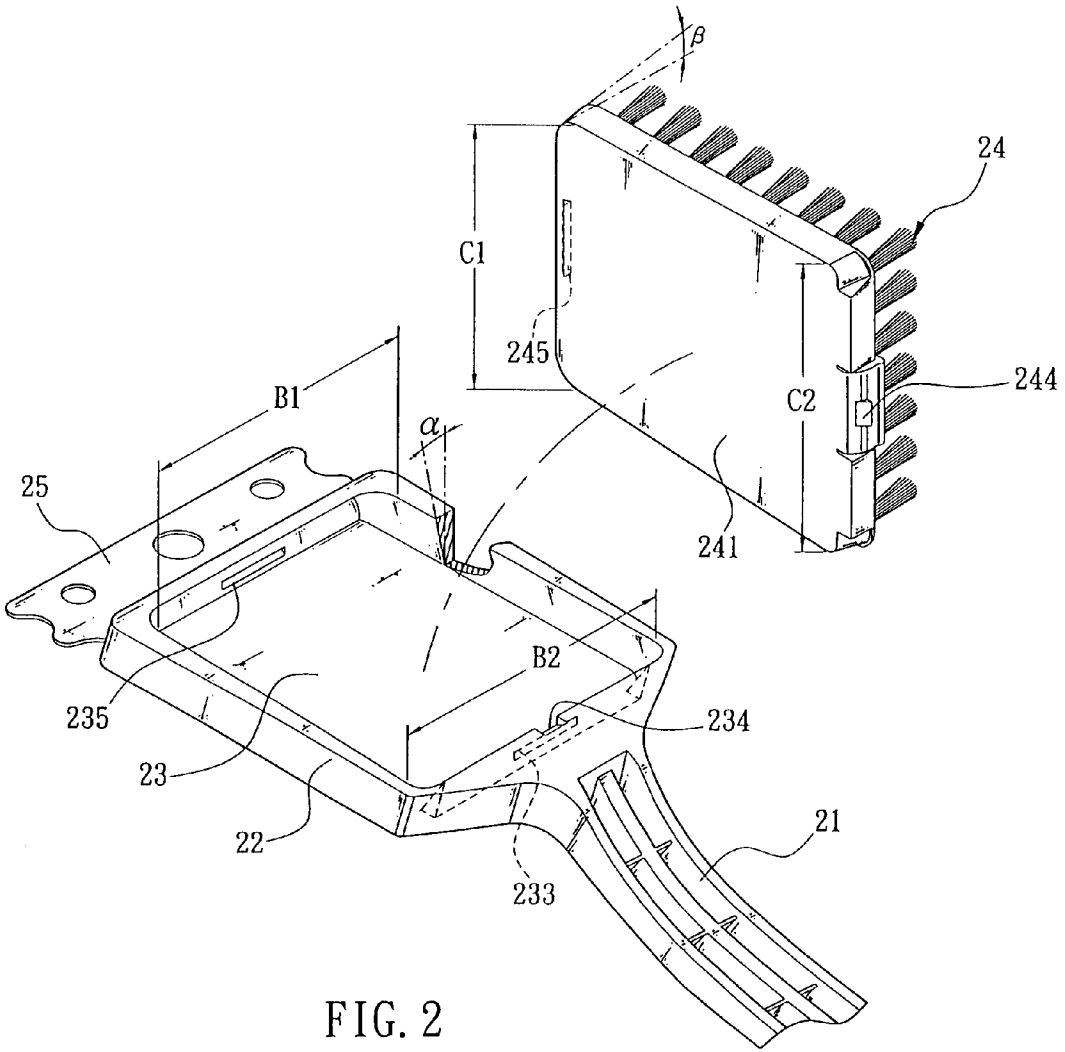
FIG. 2 is an illustrative view of the cleaning brush and its disassembled parts according to the present invention.
Figure 3:
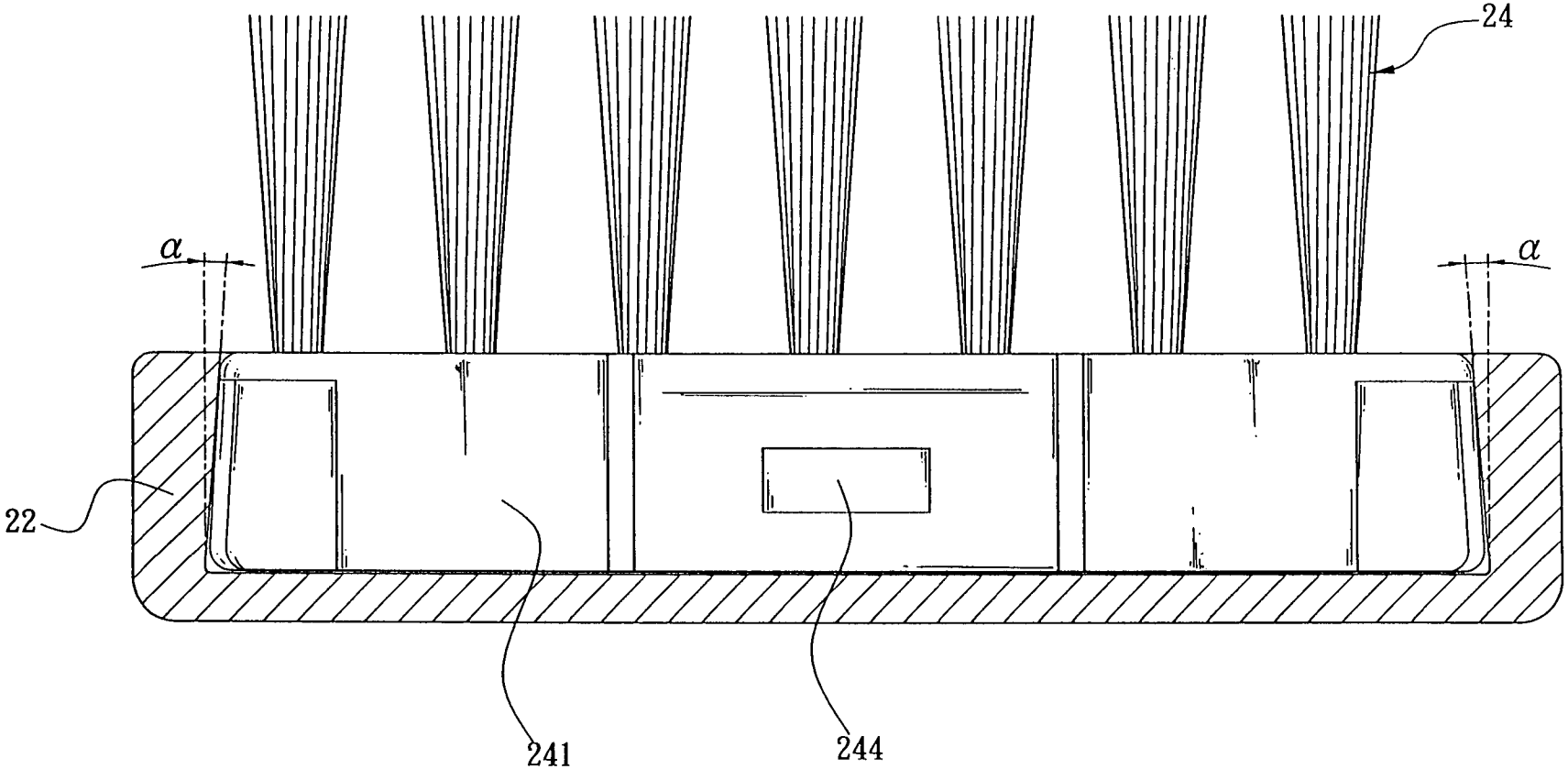
FIG. 3 is a cross-sectional view of the cleaning brush and its disassembled parts according to the present invention.
Figure 4:
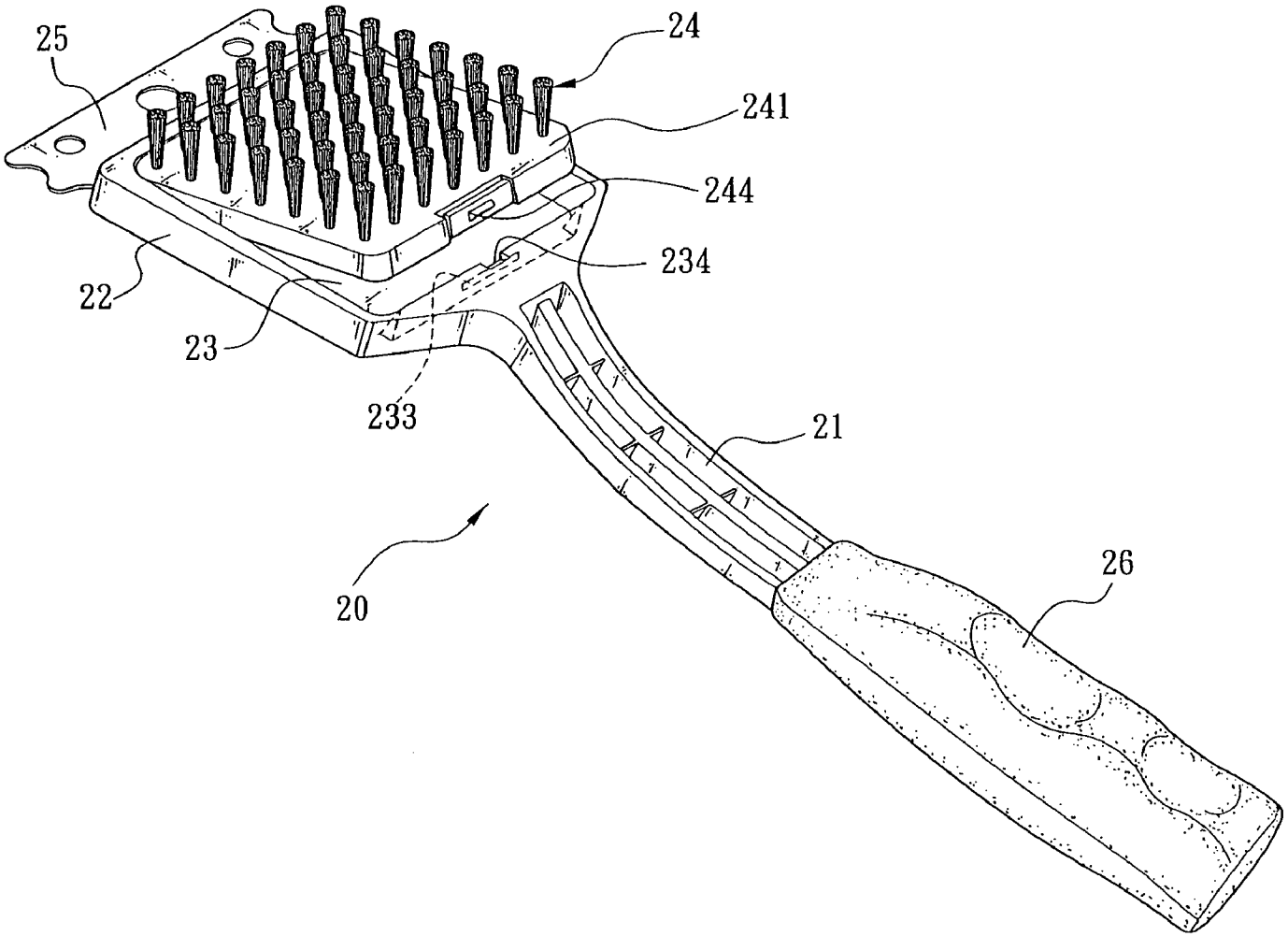
FIG. 4 is a perspective view of the cleaning brush and its components according to the present invention.

Please refer to FIGS. 2, 3 and 4 for a cleaning brush structure with a replaceable brush hair plate of the present invention. The cleaning brush 20 comprises a slender rod body 21, a plate member 22 extended from one end of the slender rod body 21 and an accommodating groove 23 disposed on one side of the plate member 22, wherein the accommodating groove 23 is tapered in width from a rear end B2 to a corresponding front end B1 such that the internal walls on two opposite sides at the positions adjacent to the front end B1 slightly face a bottom surface inside the accommodating groove 23 to define an opening above the accommodating groove 23. The two internal walls are inclined to slightly face the bottom of the accommodating groove 23 at an angle of inclination $\alpha$ that increases from the rear end B2 to the front end B1. Therefore, the opening at the front end B1 is slightly smaller than the bottom as shown in FIGS. 2 and 3. A first latch groove 233 is disposed in a wall at the rear end B2 of the accommodating groove 23, and an indented opening 234 is dispose on the first latch groove 233 such that a baseboard 241 of a brush hair plate 24 is embedded precisely into the accommodating groove 23 and the brush hair plate 24 is exposed from the accommodating groove 23 to define a cleaning head, and a second latch groove 235 is disposed in a wall at the front end B1 of the accommodating groove 23 as shown in FIG. 2.

In the present invention, the baseboard 241 has the same characteristics as the accommodating groove 23, such that the front end C1 of the baseboard 241 is slightly narrower than its corresponding rear end C2 as shown in FIG. 2, and the two corresponding sidewalls of the baseboard 241 are inclined at an appropriate angle of inclination $\beta$, that increases from the rear end C2 to the front end C1 to correspond to the internal walls of the accommodating groove 23. A triangular resilient latch 244 (however, the persons skilled in the art may use any other equivalent component to substitute this component) is disposed on the wall at the rear end C2 of the baseboard 241, so that if the baseboard 241 is embedded into the accommodating groove 23, the resilient latch 24 will be embedded precisely into the first latch groove 233 in the wall at the rear end B2 of the accommodating groove 23. Further, a triangular protruded latch 245 is disposed on the wall at the front end C1 of the baseboard 241, such that the protruded latch 245 assists the baseboard 241 to be embedded successfully into the second latch 235 of the accommodating groove 23. In addition, a metal plate 25 is protruded from the front of the plate member 22 as shown in FIGS. 2 and 4 for the cleaning brush 20 to remove a tough dirt or stain. However the persons skilled in the art may use any other equivalent component to substitute the metal plate 25.

Further, the brush hair plate 24 of the baseboard 241 comprises a plurality of brush hairs or scrubbing cloths. The embodiments as shown in the figures adopt the brush hair (however the persons skilled in the art may use any other equivalent component to substitute this component). Further, a handle 26 is disposed on the other end of the slender rod body 21 as shown in FIG. 4 as to facilitate users to hold the handle 26 for performing the cleaning job.

From the special design of the aforementioned accommodating grooves and the baseboard 241 as shown in FIGS. 2 and 4, it is clear that the front end C1 of the baseboard 241 is able to be slidingly inserted into the accommodating groove 23 from the rear end B2 to the front end B1 thereof at an appropriate angle. The rear end B2 of the accommodating groove 23 is slightly broader than its front end B1, and the front end C1 of the baseboard 241 is slightly narrower than its rear end C2, and the accommodating groove 23 has an opening slightly smaller than its bottom.

Therefore, the baseboard 241 will be positioned in the accommodating groove 23, such that the protruded latch 245 in the wall C1 at the front end C1 of the baseboard 241 is latched into the second latch groove 235 in the wall at the front end B1 of the accommodating groove 23, the baseboard 241 being fixedly and fully accommodated in the accommodating groove 23 when the baseboard 23 is pressed down to latch the resilient latch 244 on the wall of the rear end C2 thereof precisely into the first latch groove 233 in the wall at the rear end B2 of the accommodating groove 23.

On the other hand, if it is necessary to remove the baseboard 241 for replacement or cleaning, the resilient latch 244 is pressed from the indented opening 234 of the accommodating groove 23 to lift the rear end C2 of the baseboard 241 as shown in FIGS. 2 and 4. In the meantime, since the front end C1 of the baseboard 241 and the front end B1 of the accommodating groove 23 are in the tightened condition and have a clamping effect, therefore the baseboard 241 will not be separated as a whole. Then, the front end C1 of the baseboard 241 is taken out from the front end B1 of the accommodating groove 23 towards its rear end B2 to effectively prevent the baseboard 241 from affecting or endangering the environment when the baseboard 241 flies out due to the excessive applied force.

In summation of the description above, the special design of the accommodating groove 23 on the plate member 22 of the cleaning brush 20 working in conjunction with the baseboard 241 of the brush hair plate 24 according to the present invention will have the following advantages.

1. Since the rear end B2 of the accommodating groove 23 is slightly broader than the front end B1 of the accommodating groove 23 and the front end C1 of the baseboard 241 is slightly narrower than the rear end C2 of the baseboard 241 and the accommodating groove 23 has an opening being slightly smaller than its bottom and disposed above the accommodating groove 23, therefore the baseboard 241 can be securely embedded into the accommodating groove without the risk of being shaken or falling out.

2. Since the opening above the accommodating groove 23 is slightly smaller than the bottom of the accommodating groove 23 and the rear end B2 of the accommodating groove 23 is slightly broader than the front end B1, (in other words, the accommodating groove 23 is tapered in width from the front end B1 to the rear end B2), therefore users can effectively prevent the baseboard 241 from flying out due to a possible excessive applied force that may affect and endanger the environment when a user takes out the baseboard 241 for replacement or cleaning.

3. A user does not need to buy a whole cleaning brush for a specific type of cleaning. Instead, the user just needs to change the brush hair plate 24 for the desired type of cleaning. Such arrangement helps users to save costs.

While the invention has been described by means of specific embodiments, numerous modifications and variations could be made thereto by those skilled in the art without departing from the scope and spirit of the invention set forth in the claims.

What is claimed is:

1. A cleaning brush structure with replaceable brush hair plate, comprising:

a slender rod body, having a plate member extended from one end of said slender rod body and an accommodating groove disposed on one side of said plate member, said accommodating groove being tapered in width from a rear end to a narrower front end, the accommodating groove having two internal walls at opposite sides, the internal walls being inclined by an angle of inclination to slightly face a bottom surface of the accommodating groove, the angle of inclination increasing from a rear end of said accommodating groove to a front end of said accommodating groove; a first latch groove disposed in a wall at the rear end of said accommodating groove, and a second latch groove disposed in a wall at the front end of said accommodating groove, and a handle being disposed on another end of said slender rod body;

a hair brush plate, disposed on a baseboard, said baseboard being tapered in width from a rear end to a narrower front end, two corresponding sidewalls of said baseboard being inclined by an angle of inclination that increases from the rear end of the baseboard to the front end of the baseboard to correspond to the internal walls of said accommodating groove; a resilient latch disposed on a wall at the rear end of said baseboard, and a protruded latch disposed on a wall at the front end of said base board, such that said baseboard is configured and arranged to be embedded into said accommodating groove at an inclined angle and such that said protruded latch is embedded into said second latch groove and said resilient latch is latched into said first latch groove whereby said brush hair plate is exposed and fixed outside said accommodating groove to define a cleaning brush head.

2. The cleaning brush structure with replaceble brush hair plate of claim 1, wherein said first latch groove of said accommodating groove comprises an indented opening for pressing said resilient latch to lift up the rear end of said baseboard to an inclined angle for removing said baseboard, and said resilient latch disposed on the wall at the rear end of said baseboard is in a triangular shape, such that when said baseboard is embedded into said accommodating groove, said resilient latch is precisely embedded into said first latch at a corresponding inclined angle.

3. The cleaning brush structure with replaceable brush hair plate of claim 1, wherein said protruded latch disposed on a wall at the front end of said baseboard is in a triangular shape for assisting said baseboard to be embedded successfully into said second latch groove of said accommodating groove.

4. The cleaning brush structure with replaceable brush hair plate of claim 1, wherein said brush hair plate disposed on said baseboard selectively comprises a plurality of brush hairs and scrubbing cloths.

* * * * *